United States Patent [19]

Sudnishnikov et al.

[11] 3,974,885

[45] Aug. 17, 1976

[54] PNEUMATIC PERCUSSIVE POWER TOOL

[76] Inventors: Boris Vasilievich Sudnishnikov, Krasny prospekt, 56, kv. 59; Konstantin Konstantinovich Tupitsyn, ulitsa Krylova, 3, kv. 37; Sergei Konstantinovich Tupitsyn, ulitsa Zorge, 123, kv. 31; Mikhailovich Makarov, ulitsa Kamenskaya, 84, kv. 45, all of Novosibirsk, U.S.S.R.

[22] Filed: Nov. 12, 1974

[21] Appl. No.: 523,159

Related U.S. Application Data

[63] Continuation of Ser. No. 270,164, July 10, 1972, abandoned.

[52] U.S. Cl. ..... 173/121; 91/239; 91/243; 173/137; 173/162

[51] Int. Cl.[2] ..... B25D 9/04

[58] Field of Search ..... 91/234, 243, 239, 276; 173/139, 137, 162, 121

[56] References Cited

UNITED STATES PATENTS

| | | | |
|---|---|---|---|
| 864,494 | 8/1907 | Sickel | 91/239 |
| 1,843,958 | 2/1932 | Smith, Jr. | 91/239 |
| 1,861,984 | 6/1932 | Slater | 91/239 X |
| 2,259,379 | 10/1941 | Herzbruch | 91/239 |
| 2,580,747 | 1/1952 | Feucht | 173/137 X |
| 3,007,452 | 11/1961 | Lee | 91/276 |

FOREIGN PATENTS OR APPLICATIONS

| | | | |
|---|---|---|---|
| 261,319 | 8/1970 | U.S.S.R. | 173/135 |

OTHER PUBLICATIONS

Abstract of USSR Inv. Cert. 286897.

*Primary Examiner*—Ernest R. Purser
*Assistant Examiner*—William E. Pate, III
*Attorney, Agent, or Firm*—Holman & Stern

[57] ABSTRACT

A power tool having a cylindrical housing accomodating a hammer and a two-step defining piston head, with central, rear and supplementary chambers in the housing, said head and supplementary chambers being constantly intercommunicated through a passage provided in the housing. The design of the power tool is aimed at minimizing vibrations of the housing and reduction of the forces applied to the handle during normal operation of the power tool.

10 Claims, 6 Drawing Figures

PNEUMATIC PERCUSSIVE POWER TOOL

This is a Rule 60 Continuation application of Ser. No. 270,164, filed July 10, 1972 and now abandoned.

BACKGROUND OF THE INVENTION

This invention relates to pneumatic percussive power tools which may be used in the mining industry, as well as in machine building, metallurgy and for construction working (hammers, chipping and riveting hammers, concrete breakers, rock drills, and etc.).

PRIOR ART

The main disadvantage of widely used conventional percussive power tools consists in the intensive vibrations of the power tool housing and the great force necessarily applied to the handle in order to ensure normal operation of the power tool. For this reason, a further increase in the power of hand power percussive tools, while being badly needed, is now limited by the physical and physiological abilities of man. The means that are presently used for the elimination of the above disadvantages in percussive power tools are not sufficiently effective.

Various attempts have been made to solve the problem. For example, pneumatic percussive power tools are known in this art comprising a housing having an inner cylindrical cavity accommodating a hammer and a two-step piston axially movable therein, reciprocated by compressed air, and dividing the housing cavity into a head chamber defined between the end face of the hammer nearest to the working tool and the housing, with the side of the tool having said head chamber being in periodic communication with the atmosphere during the operation of the power tool; an intermediate chamber defined between the other end face of the hammer, which faces the side opposite to the working tool, and the end face of the larger step of said piston, facing the working tool, and periodically communicating with the atmosphere and with a compressed air source; a rear chamber defined between the end face of the larger step of the piston, which faces the side opposite to the working tool which is the housing, and constantly in communication with the compressed air source; and a supplementary chamber defined between the end face of the smaller step of the piston and the housing, and periodically communicating with the atmosphere (cf. U.S.S.R. Inventor's Certificate No. 286,896).

However, this conventional power tool has proven to be inoperative and has not found practical use. The speed of the return stroke of the hammer in this machine is determined mainly by the speed of recoil of the hammer from the working tool shank. Since the rate of recoil of the hammer from the working tool is generally small, the speed of the return stroke of the hammer is low, and therefore, the power tool becomes rather sensitive to the various kinds within clogging of the housing inner cavity, (such clogging usually accompanying the operation of the power tool), as well as to low temperatures of the surrounding atmoshpere, with all this making these power tools unreliable in operation. An increase in the speed of the return stroke of the hammer may be achieved by raising the air compression ratio in the head chamber, but, this is detrimental of power and vibration characteristics of the power tool.

OBJECTS AND SUMMARY OF THE INVENTION

It is an object of this invention to eliminate the above disadvantages.

It is also an object of this invention to provide such a pneumatic percussive power tool that will minimize vibrations in the housing and decrease the forces which have to be applied to the handle thereof.

Another object of the invention is to improve the starting conditions of the power tool and to reduce the effects of clogging within the inner cavity of the power tool housing on these conditions.

These and other objects of the invention are accomplished by the provision of a pneumatic percussive power tool comprising a housing having an inner cylindrical cavity accommodating a hammer and a two-step piston which moves in the axial direction, is reciprocated by compressed air and divides said cavity of the housing into an intermediate chamber disposed therebetween and periodically communicating with the atmosphere and a source of compressed air imparting motion to the hammer in order to make it deliver an impact onto a working tool shank disposed in the head portion of the housing and intended to act upon an object being treated, a head chamber defined between the end face of said hammer, facing the working tool, and the housing at the side of the tool, periodically communicating with the atmosphere, which ensures compression of said air during the direct stroke of the hammer and also attributing to the return stroke of the hammer; a rear chamber disposed in the rear portion of the housing, defined by the housing walls and said piston, and continuously in communication with the compressed air source permanently urging said piston in the direction of the working tool; and a supplementary chamber also disposed in the rear portion of the housing, and defined by the housing walls and the piston, which periodically communicates with the atmosphere, ensuring a change in the air pressure taking place under the action of the piston movement, and limiting the amplitude of the piston stroke. In accordance with the invention, the head and supplementary chambers are constantly in communication by means of passage.

It is expedient to define the supplementary chamber by the larger step of the piston, which faces the side that is opposite the working tool, and the external side face of the smaller step of the piston and the housing, and the rear chamber by the end face of the smaller step of the piston and the housing. It is also expedient to provide the housing with an auxiliary port used to discharge exhausted air from the intermediate chamber, and to define the intermediate chamber by the walls of the housing and the external side face of the smaller step of the piston, with said intermediate chamber periodically communicating with the rear chamber which is defined by the end face of the smaller step of the piston and the housing.

The above described arrangement makes it possible to reduce the length of the passage communicating with the head and supplementary chambers and, therefore, to simplify the process of manufacture of the power tool.

It is also advisable to provide a channel in the housing which channel constantly provides communication between the intermediate chamber and the central one which makes it possible to simplify the geometrical shape of the piston.

It is no less expedient to provide a groove on the external side face of the smaller step of the piston, with said groove periodically communicating the intermediate chamber with the rear one and cutting-off the communication the moment the compressed air is admitted into the central chamber.

This groove ensures an exact proportioning of the compressed air consumed during every cycle of the power tool operation. In this case the intermediate chamber will function as a proportioning one.

It is also expedient to provide an annular groove along the inner surface of the housing, with said groove being in communication with a passage interconnecting the head and supplementary chambers, and a passage in the piston, terminating in the external side face of the larger step of the piston, said passage being continuously in communication with the rear chamber and periodically in communication with said groove made in the housing.

This will ensure admission of compressed air into the head and supplementary chambers at the beginning of the return stroke of the hammer, thereby increasing the speed of the return stroke of the hammer (reducing the time necessary for the return stroke), and increasing the frequency of strokes and, consequently the power of the power tool without changing its over-all dimensions.

It is also expedient to provide a resilient means between the hammer and the piston in order to prevent a direct collision thereof, to dampen the vibrations of the housing and to utilize the energy of the return stroke of the hammer and the piston during the working stroke.

As a result of the present invention, there has been provided an improved pneumatic percussive power tool which is more reliable in operation (the improvements consist in better starting conditions and in diminishing the effects of various kinds of clogging of the inner cavity of the housing due to the stability of the power tool performance). Furthermore, the main source of vibrations of the housing resulting from variable pressure forces of the compressed air in the working chambers of the power tool is completely eliminated, and the required force to be applied to the handle in order to ensure normal operation of the power tool is also considerably reduced.

The following description of exemplary embodiments of the present invention is given with reference to the accompanying drawings, in which:

DETAILED DESCRIPTION OF THE INVENTION

Figure 1:
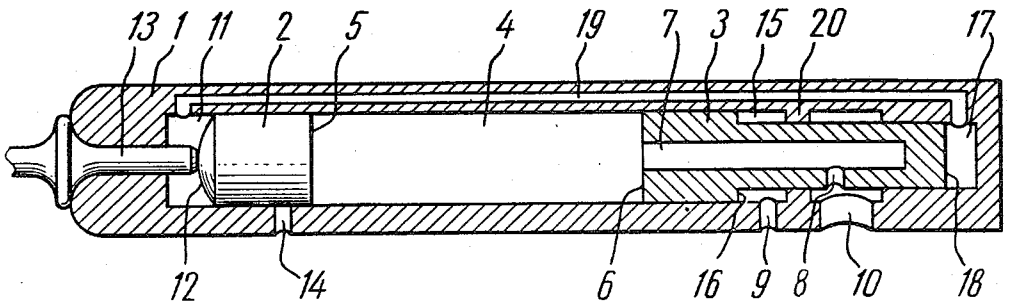
FIG. 1 is a schematic longitudinal sectional view of a pneumatic percussive power tool constructed in accordance with the present invention.

Referring now to the drawings and, particularly, to FIG. 1, the pneumatic percussive power tool comprises a housing 1 having an inner cavity accommodating hammer 2 and a two-step piston 3 moving in the axial direction and dividing the housing cavity of the housing 1 into the following four chambers:

- a central chamber 4 disposed between the piston 3 and the hammer 2, and defined by an end face 5 of the hammer 2, an end face 6 of the piston 3 and the walls of the housing, and depending on the position of the piston relative to the housing, periodically communicates with a compressed air source through a passage 7, a port 8 of the piston and a port 9 in the housing wall, or with the atmosphere through the same passage 7, the port 8 of the piston 3 and through a second port 10 in the housing wall;
- a head chamber 11 defined by an end face 12 of the hammer 2, facing a working tool 13, and the walls of the housing, said chamber, depending on the position of the hammer relative to the housing, being periodically communicating with the atmosphere through a port 14 provided in the wall of the housing;
- a rear chamber 15 defined by an end face 16 of the larger step of the piston 3, facing the side opposite to the working tool 13, the external side face of the smaller step of the piston and the walls of the housing 1, with said chamber constantly communicating with the compressed air source through the port 9;
- a supplementary chamber 17 defined by an end face 18 of the smaller step of the piston and the housing walls, said chamber constantly communicating through a passage 19 in the housing wall with the head chamber 11 which, in its turn, periodically communicates with the atmosphere through the port 14.

An annular shoulder 20 is provided in the housing, said shoulder separating the rear chamber 15 from the port 10 which communicates communicated with the atmosphere.

The power tool operates as follows. When the above-described power tool is started, the port 9 provided in the housing communicates with the rear chamber 15 via the compressed air source and the piston 3 and the hammer 2 start reciprocating. Upon alignment of the port 8 of the piston with the rear chamber 15, the compressed air is admitted into the central chamber 4. Under the action of the air pressure developed in this chamber 4 the hammer moves in the direction of the working tool (i.e. performs its working stroke), while the piston moves in the opposite direction due to the fact that the working area of the end face 6 of the piston exposed to the pressure of the compressed air in the central chamber is greater than the working area of the end face 16 of the piston which is also exposed to the pressure of the compressed air in the rear chamber 15. During its working stroke, the hammer overlaps the port 14 in the housing and, during its further movement, compresses the air cushion formed in the head chamber 11 and, then, delivers a blow upon the working tool 13.

By the time the hammer delivers a blow upon the working tool 13, the piston during its movement in the direction away from the working tool occupies a position relative to the housing in which the port 8 moves beyond the annular shoulder 20 of the housing and communicates with the port 10. At this moment the used air is discharged from the central chamber 4 through the passage 7, the port 8 in the piston and the port 10 in the housing (these relative positions of the piston and the hammer are shown in FIG. 1).

As a result of the impact delivered by the hammer upon the working tool 13, the latter, due to the recoil and force of the compressed air in the head chamber 11, will move in the direction to the piston 3 (i.e. will perform its return stroke), while the piston 3 will come to a stop and commence its movement towards the hammer under the action of the compressed air in the rear chamber 15 and supplementary chamber 17. During its return stroke the hammer will open the port 14, whereupon the chambers 11 and 17 will communicate with the atmosphere through the port 14. The hammer will further continue its movement by inertia, whereas the piston, while moving towards the hammer will occupy such a position, relative to the housing, in which the port 8 provided in the piston will pass beyond the shoulder 20 of the housing and will be aligned with the rear chamber 15. At this moment, the central chamber 4 communicates with the compressed air source through the port 9 in the housing, the port 8 and the passage 7 provided in the piston. Hence, the hammer and the piston come to a stop and, then, continue moving in the opposite direction under the action of compressed air in the central chamber. Now, the hammer again performs its working stroke, whereas the piston, while moving relative to the housing, occupies a position in which the port 8 of the piston is aligned with the port 10 in the housing. Concurrently, the used air is discharged from the central chamber 4 into the atmosphere. Then, the cycle is repeated.

Figure 2:
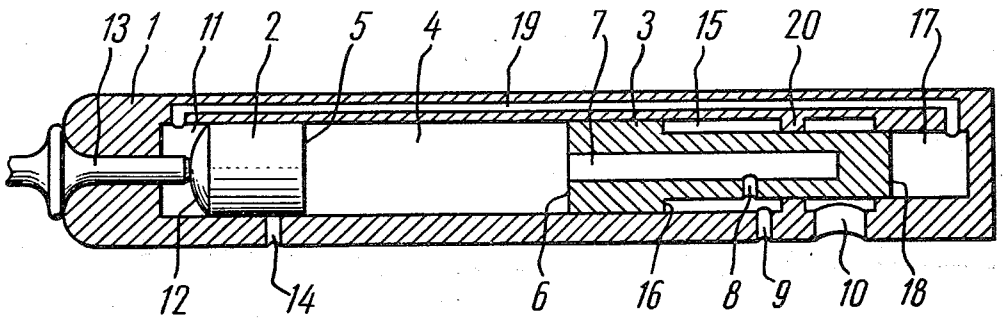
FIG. 2 is the same view as in FIG. 1, but with the hammer and piston occupying their extreme forward positions.

The passage 19 in the housing 1 and intercommunicating chambers 11 and 17 ensures a reliable start up of the power tool irrespective of the hammer and the piston position. The most unfavorable starting conditions will be in the case when the hammer 2 engages the working tool 13 (i.e. when the working tool is directed downwardly). In this case, the pistons 3 also occupies its extreme lower position. These positions of the hammer and the piston are shown in FIG. 2.

Upon starting the power tool with the above described relative positions of the piston and the hammer in the housing, compressed air is supplied into central chamber 4 through the port 9 provided in the housing, the port 8 and the passage 7 in the piston. At this moment, the hammer is kept motionless, while the piston continues moving under the action of the pressure force of compressed air in the central chamber from the hammer to compress air in the supplementary chamber 17. The chamber 17 is placed in communication with the chamber 11 through the passage 19 made in the housing, as a result of which the pressure in the head chamber 11 rises. After discharging the used air from the central chamber 4, the hammer under the action of the pressure force of the compressed air in the head chamber 11 displaces towards the piston, and the latter comes to a stop under the action of the pressure force of the compressed air in the chambers 15 and 17, and, then starts moving towards the hammer. The further operation of the power tool is a similar to the aforedescribed one.

The provision in the housing 1 of the passage 19 communicating the head chamber 11 with the supplementary chamber 17 makes it possible to substantially reduce the vibrations in the housing. Due to this passage 19, the pressure in the chamber 11 equals that in the chamber 17. The pressure force of the compressed air in the head chamber 11 acts on the housing in the direction of the working tool 13, while that of the compressed air in the supplementary chamber 17 acts on it in the opposite direction. With the areas exposed to the action of these forces being equal to each other, the forces will be counter-balanced. The only unbalanced force is the compressed air, acting upon the housing which remains to be the force which acts upon the annular shoulder 20 provided in the housing 1, with this force acting from the side of the rear chamber 15 in the direction opposite to the working tool. As the pressure in the rear chamber 15 communicating with the pressurized air source is constant, the force applied to the housing of the power tool from the side of the rear chamber will also be constant. Therefore, the vibrations resulting from variations of the air pressures in the different chambers of the power tool will be completely eliminated.

Furthermore, due to the provision of the passage 19 intercommunicating with the head chamber 11 and the supplementary chamber 17 and, due to the counterbalancing of the pressure forces of air pressure applied to the housing of the power tool from the side of these chambers, the forces that are to be applied to the handle (not shown) of the power tool in its normal operation will be less than those applied in the case of power tools of the same type.

The reduction in forces applied by the operator to the handle of the power tool diminishes in its turn, and the harmful effect on the operator's body, caused by vibrations other than those resulting from the variations of the air pressure in the different chambers of the power tool, i.e. the vibrations caused by the impacts delivered upon the housing by the working tool 13 at the moment of recoil thereof.

The following designations for the different parts to be used in this description are found in the accompanying drawings:

Only reference numerals having no alphabetical symbols are used in FIGS. 1 and 2.

The structures in FIGS. 3, 4, 5 and 6 have structures and forms similar to those illustrated in FIGS. 1 and 2 and are designated by the same reference numerals without any index.

Figure 3:
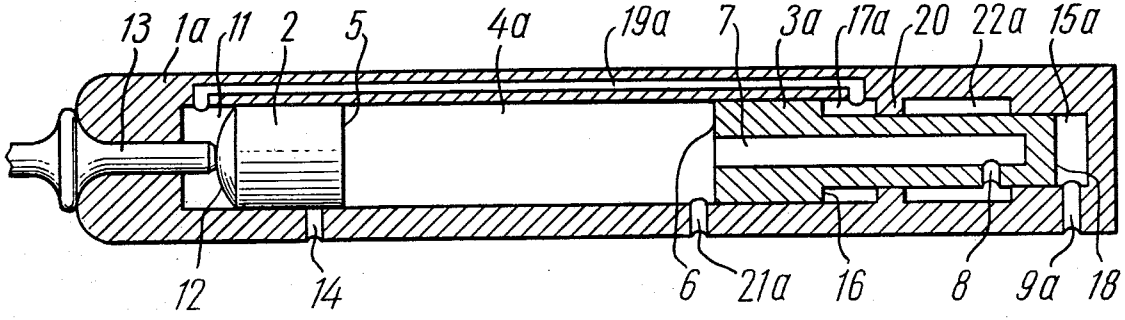
FIG. 3 shows a pneumatic power tool constructed in accordance with the present invention, in which an auxiliary chamber is defined by the walls of the housing and the external side face of the smaller step of the piston.
Figure 4:
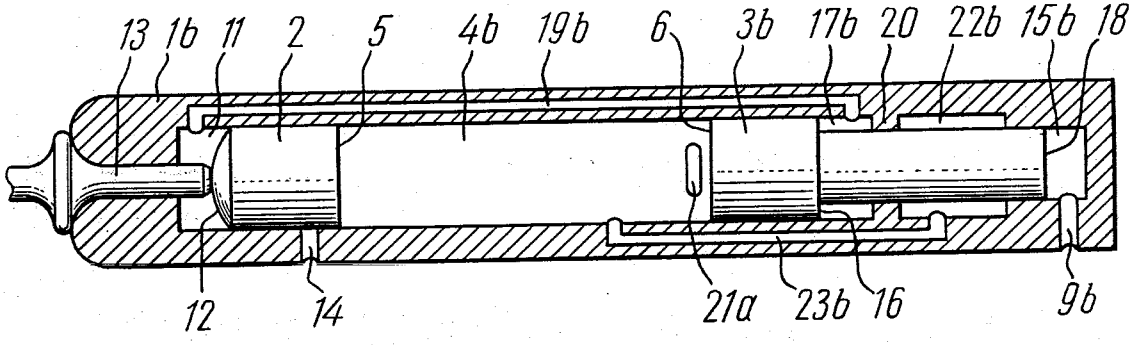
FIG. 4 shows a pneumatic power tool constructed in accordance with the present invention with the housing of the tool having a passage continuously communicating with the intermediate and central chambers.
Figure 5:
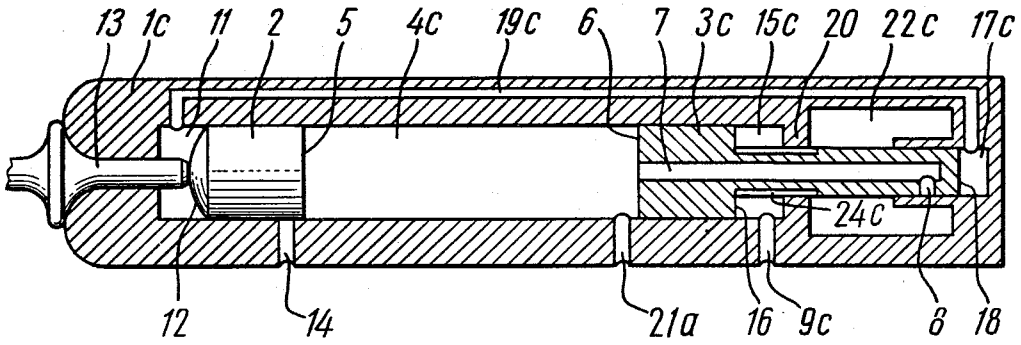
FIG. 5 shows a power tool constructed in accordance with the present invention, in which a groove is made in the external side face of the smaller step of the piston, said groove communicating with the intermediate and rear chambers.
Figure 6:
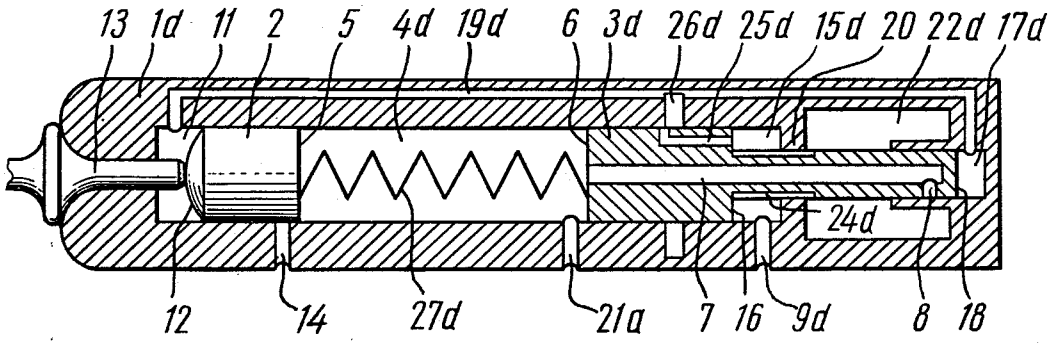
FIG. 6 shows a pneumatic power tool constructed in accordance with the present invention, which is provided with an annular groove made in the inner surface of the housing and with a passage in the piston, terminating in the external side face of the larger step thereof, with said passage continuously communicating with the rear chamber and periodically communicating with said groove in the housing, and a spring being placed between the hammer and the piston.

If in subsequent figures the parts have a modified design, then, without any change in their reference numerals, they are given alphabetical indices, and namely, the index *a* for FIG. 3, the index *b* for FIG. 4, the index *c* for FIG. 5 and the index *d* for FIG. 6.

In case new reference numerals are used in subsequent figures, they too, just like those used in FIGS. 1 and 2, may either bear the same form or a change in the above described manner.

The power tool shown in FIG. 3 differs from that illustrated in FIGS. 1 and 2 by the fact that the supplementary chamber 17*a* of this power tool is defined by the end face 16 of the larger step of the piston 3*a* and the walls of the housing 1*a*. The rear chamber 15*a* in this pneumatic power tool is defined by end face 18 of the smaller step of the piston 3*a* and the walls of the housing 1*a*. Compressed air is supplied to the chamber 15*a* through the port 9*a* provided in the housing 1*a*. Used air is discharged from the central chamber 4*a* through the port 21*a* provided in the housing 1*a*. Furthermore, this power tool differs from the former one by that it is provided with an intermediate chamber 22*a* defined by the external side face of the smaller step of the piston 3*a* and the walls of the housing 1*a*.

In this power tool, compressed air is admitted into the central chamber 4*a* after the piston 3*a* moving in the direction of the working tool overlaps the port 21*a*, and the end face 18 of the piston 3*a* enters the intermediate chamber 22*a*. Concurrently, the compressed air is supplied from the rear chamber 15*a* communicating with the compressed air source through the port 9*a* to the intermediate chamber 22*a*, and farther to the central chamber 4*a* through the port 8 and the passage 7 in the piston 3*a*. Under the action of the compressed air admitted to the central chamber 4*a*, the hammer 2 and the piston 3*a* come to a stop and, then, start moving in opposite directions. By the time the hammer imparts a blow to the working tool 13, the piston 3*a* occupies such a position relative to the housing, that the end face 18 of the piston 3*a* passes beyond the limits of the intermediate chamber 22*a* and the port 21*a* of the housing is opened. At this time, used air is discharged from the central chamber 4*a* through the port 21*a* provided in the housing 1*a*. From now on the operation of the power tool according to FIG. 3 will be similar to the operation of the power tool described according to FIGS. 1 and 2.

The advantage of the power tool described according to FIG. 3 consists in the fact that the length of the passage 19*a* intercommunicating the head chamber 11 with the supplementary chamber 17*a* is shorter than that of the passage 19 communicating the head chamber 11 with the supplementary chamber 17 according to FIGS. 1 and 2, with this making it possible to simplify the process of the power tool manufacture.

The power tool illustrated in FIG. 4 differs from that shown in FIG. 3 by the fact in the former the central chamber 4*a* is constantly communicating with the intermediate chamber 22*b* through the passage 23*b* in the housing 1*b*.

In this power tool, compressed air is admitted into the central chamber 4*b* after the port 21*a* is overlapped by the piston 3*b* moving in the direction of the working tool and the end face 18 of the piston 3*b* enters the intermediate chamber 22*b*. Thus, the compressed air contained in the rear chamber 15*b* communicating with the compressed air source by means of the port 9*b* is supplied to the intermediate chamber 22*b* and further to the central chamber 4*b* through the passage 23*b* provided in the housing 1*b*. Under the action of the compressed air supplied to the central chamber, the hammer 2 and the piston 3*b* come to a stop and then start moving in opposite directions. From that point on the operation of the power tool according to FIG. 4 is similar to that of the power tool described according to FIG. 3.

The provision of the passage 23*b* in the housing 1*b* of the present power tool makes it possible to use the piston 3*b* having a simple geometric form, i.e. having no internal passage therein or ports.

The pneumatic power tool shown in FIG. 5 differs from the power tool illustrated in FIG. 3 by the fact that in the former, the supplementary chamber 17*c* is defined by the end face 18 of the smaller step of the piston 3*c* and the walls of the housing 1*c*, while the rear chamber 15*c* is defined by the end face 16 of the larger step of the piston 3*c* and the walls of the housing 1*c*. Also, the power tool is characterized by the fact that provided on the external face of the smaller step of the piston 3*c* is the groove 24*c* periodically communicating, depending upon the position of the piston relative to the housing, with the intermediate chamber 22*c* with the rear chamber 15*c*. During the start up of the power tool, the compressed air is supplied to the rear chamber 15*c* through the port 9*c* communicating with the compressed air source and farther to the auxiliary chamber 22*c* via the groove 24*c* of the piston 3*c* (the position of the piston at this moment is shown in FIG. 5). Under the action of the compressed air in the rear chamber 15*c*, the piston 3*c* moves in the direction of the working tool 13 and occupies such a position, with respect to the housing 1*c*, in which the groove 24*c* of the piston 3*c* passes beyond the limits of the shoulder 20 and stops communication between the chamber 15*c* and the chamber 22*c*. During further movement of the piston 3*c* in the direction of the working tool it overlaps the port 21*a* provided in the housing 1*c*, whereat the port 8 of the piston 3*c* is aligned with the intermediate chamber 22*c*, whereupon compressed air received in the intermediate chamber 22*c* is supplied into the central chamber 4*c* through the port 8 and the passage 7 provided in the piston 3*c*. Under the action of the pressure force of the compressed air admitted to the central chamber 4*c*, the hammer 2 and the piston 3*c* come to a stop and, then start moving in opposite directions. At the moment the hammer 2 delivers a blow upon the working tool 13, the piston 3*c* occupies a position with respect to the housing in which the port 8 of the piston 3*c* has passed beyond the limits of the intermediate chamber 22*c*, the port 21*a* is opened and the groove 24*c* again communicates the chamber 15*c* with the chamber 22*c*. Concurrently, the used air is discharged from the central chamber 4*c* through the port 21, and a new amount of compressed air is supplied to the intermediate chamber 22*c* via the groove 24*c* from the rear chamber 15*c* which is communicated with the compressed air source. Further operation of the power tool shown in FIG. 5 is similar to that power tool described according to FIG. 3.

Thus, the groove 24*c* in the external face of the smaller step of the piston 3*c*, while periodically communicating the intermediate chamber 22*c* with the rear chamber 15*c* ensures consumption of a quite definite and well-proportioned amount of compressed air during every cycle of the power tool operation. The power tool constructed as shown in FIG. 5 is more economical from the viewpoint of air consumption.

The pneumatic power tool illustrated in FIG. 6 differs from the power tool shown in FIG. 5 by the fact that the piston 3*d* is provided with an auxiliary passage 25*d* terminating in the side wall of the piston constantly communicating with the rear chamber 15*d*. The inner surface of the housing 1*d* is also provided with an annular groove 26*d* constantly communicating with the passage 19*d* provided in the housing 1*d* and, depending on the position of the piston relative to the housing, periodically communicating with the passage 25*d* of the piston 3*d*. A spring 27*d* accumulates impact energy generated during the movement of the piston 3*d* and the hammer 2 towards each other and releases this energy during their movement in opposite directions and is located between the hammer and the piston in the central chamber 4*d*.

Upon starting the power tool, the compressed air is delivered to the rear chamber 15*d* through the port 9*d* communicating with the compressed air source and, then is admitted to the intermediate chamber 22*d* via the groove 24*d* in the piston 3*d*. Under the action of the pressure force of the compressed air in the rear chamber 15*d*, the piston 3*d* moves towards the hammer 2, and while moving in this direction it occupies such positions in which the groove 24*d* passes beyond the shoulder 20 of the housing 1*d*, at which time the piston overlaps the port 21 in the housing, and the port 8 of the piston is aligned with the intermediate chamber 22*d*; and the compressed air from the intermediate chamber 22*d* is delivered to the central chamber 4*d* through the port 8 and the passage 7 of the piston 3*d*. Under the action of the pressure forces of the compressed air in the central chamber 4*d* and the resilient force of the spring 27*d*, the hammer 2 and piston 3*d* come to a stop, and then start moving in opposite directions. At the time the hammer 2 delivers an impact upon the working tool 13, the piston occupies such a position, with respect to the housing, in which the port 8 of the piston 3*d* passes beyond the limits of the intermediate chamber 22*d*, and the port 21*a* in the housing 1*d* is opened (which ensures discharge of the used air from the central chamber 4*d*), and the groove 24*d* of the piston 3*d* re-establishes the communication between the rear chamber 15*d* and the intermediate chamber 22*d*. At the moment of the recoil of the hammer 2 from the working tool 13, the piston occupies such a position, with respect to the housing, that the point of termination of the passage 25*d* in the side wall of the piston 3*d* is aligned with the groove 26*d* provided in the housing 1*d*. From the rear chamber communicating with the compressed air source through the port 9*d*, the compressed air flows into the head chamber 11 and the supplementary chamber 17*d* through the passage 25*d* in the piston 3*d*, the groove 26*d* provided in the housing 1*d*, and the passage 17*d*. As a result of the recoil from the working tool 13 and under the action of the pressure forces of the compressed air in the head chamber 11, the hammer 2 performs its return stroke to compress the spring 27*d*, *and the piston 3d* under the action of the pressure forces of the compressed air in the rear chamber 15*d* and in the supplementary chamber 17*d* comes to a stop and starts moving towards the hammer thereby also compressing the spring 27*d*. Before the hammer 2 opens the port 14 in the housing 1*d*, the piston 3*d* occupies such a position, with respect to the housing 1*d*, in which the point of termination of the passage 25*d* in the side wall of the larger step of the piston goes beyond the limits of the groove 26*d* in the housing 1*d*. With the port 14 in the housing 1*d* open, the used air is discharged from the head chamber 11 and the supplementary chamber 17*d* into the atmosphere via the port 14. Then, the hammer starts moving under inertia towards the piston 3*d*. Concurrently, the spring 27*d* continues to be compressed, and the piston 3*d*, while moving towards the hammer 2, breaks communication between the rear chamber 15*d* and the intermediate chamber 22*d* (the groove 24*d* of the piston 3*d* passing beyond the limits of the shoulder 20 provided in the housing 1*d*) by overlapping the port 21*a* in the housing 1*d* and communicating the port 8 in the piston 3*d* with the intermediate chamber 22*d*. Thereafter, compressed air is admitted into the central chamber 4*d*, and the cycle is repeated.

The passage 25*d* terminating in the side wall of the larger step of the piston 3*d* and the groove 26*d* provided in the housing 1*d* make it possible, at the beginning of the return stroke of the hammer 2, to supply compressed air into the head chamber 11 and into the supplementary chamber 17*d* from the rear chamber 15*d* which communicates with the compressed air source through the port 9*d*. This, in its turn, makes it possible to reduce the time necessary for the return stroke of the hammer (i.e., the hammer performs its return stroke during a shorter period of time). As the time period of the return stroke of the hammer becomes shorter, the frequency of impacts rises, which results in a power tool having higher efficiency.

The spring 27*d* located between the hammer 2 and the piston 3*d* prevents direct collision between both, which provides for a reduction in vibrations and noise, as well as a longer service life for the power tool.

What is claimed is:

1. A pneumatic percussive power tool, comprising: a housing (1) having an inner cylindrical cavity accommodating a working tool (13) in the head portion thereof; a dynamically-balanced percussive mechanism located in said cavity of the housing and including a hammer (2) and a two-step balancing piston valve (3) disposed so that the length of its stroke can be adjusted automatically, said hammer and said piston valve reciprocating under the action of compressed air so that at the end of forward strokes the hammer (2) delivers blows on the tool (13) for acting on an object being treated, said hammer (2) and said balancing piston valve (3) dividing the inner cylindrical cavity of the housing into a head chamber (11), defined by the working tool (13), the housing and the hammer (2); a central chamber (4), defined by the end face of the hammer (2) facing in the direction away from the tool, the housing and the end face of a larger step of the balancing piston valve (3), facing toward the tool; a rear chamber (15), defined by the end face of the larger step of the piston valve (3) facing in the direction away from the tool, the walls of the housing and the side surface of a smaller step of the piston valve (3); and a supplementary chamber (17), defined by the walls of the housing (1) and the end face of the smaller step of the piston valve (3) facing in the direction away from the tool; a longitudinal passage (7) provided in the balancing piston valve (3)

and communicating permanently with the central chamber (4); a radial port (8) in said piston valve (3) and communicating permanently said longitudinal passage (7) with the side surface of the smaller step of the piston valve (3); another port (9) in the rear part of the housing (1) and communicating permanently the rear chamber (15) for connection to a compressed air source; a further port (10) in the rear part of the housing (1), communicating permanently with the atmosphere; a passage (19) in the housing (1) communicating permanently the head chamber (11) and the supplementary chamber (17); a port (14) provided in the front part of the housing (1) for communicating the head chamber (11) with the atmosphere when the hammer (2) is so disposed relative to the housing (1) that said further port (14) is not closed by the hammer (2); the central chamber (4) communicating with the compressed air source, when the balancing piston valve (3) is so disposed relative to the housing (1) that said radial port (8) of the piston valve (3) is aligned with the rear chamber (15), said central chamber (4) communicating with the atmosphere when said piston valve (3) is so disposed relative to the housing (1) so that said radial port (8) of the piston valve (3) is aligned with said another port (10) of the housing (1) communicating with the atmosphere.

2. A pneumatic tool as claimed in claim 1, wherein the central chamber (4) accommodates a spring (27) disposed between the hammer (2) and the piston valve (3) to prevent colliding engagement therebetween.

3. A pneumatic percussive power tool, comprising: a housing (1*a*) having an inner cylindrical cavity accommodating a working tool (13) in the head portion thereof; a dynamically balanced percussive mechanism located in said cavity of the housing and including a hammer (2) and a two-step balancing piston valve (3*a*) disposed so that the length of its stroke can be adjusted automatically; said hammer and said piston valve reciprocating under the action of compressed air so that at the end of forward strokes the hammer (2) delivers blows on the tool (13) for acting on an object being treated; said hammer (2) and said balancing piston valve (3*a*) dividing the inner cylindrical cavity of the housing into a head chamber (11), defined by the working tool (13), the walls of the housing and the hammer (2); a central chamber (4*a*), defined by the end face (5) of the hammer (2) facing in the direction away from the tool, the walls of the housing and the end face (6) of a larger step of the balancing piston valve (3*a*) facing toward the tool; a rear chamber (15*a*), defined by the walls of the housing (1*a*) and the end face (18) of a smaller step of the piston valve (3*a*), facing in the direction away from the tool; a supplementary chamber (17*a*), defined by the end face (16) of the larger step of the piston valve (3*a*), the walls of the housing (1*a*), and the side surface of the smaller step of the piston valve (3*a*); and an intermediate chamber (22*a*), defined by the walls of the housing (1*a*) and the side surface of the smaller step of the piston valve (3*a*); a longitudinal passage (7) provided in the balancing piston valve (3*a*) and communicating permanently with the central chamber (4*a*); a radial port (8) in said piston valve (3*a*) and constantly communicating said longitudinal passage (7) with the side surface of the smaller step of the piston valve (3*a*); another port (9*a*) in the rear part of the housing (1*a*) and communicating permanently the rear chamber (15*a*) with a compressed air source; a further port (14) provided in the front part of the housing (1*a*), for communicating permanently the head chamber (11) with the atmosphere, when the hammer (2) is so disposed relative to the housing (1*a*) that said port (14) is not closed by the hammer (2); a passage (19*a*) provided in the housing (1*a*) and communicating permanently the head chamber (11) with the supplementary chamber (17*a*); an additional port (21*a*) provided in the housing (1*a*) communicating permanently with the atmosphere; said central chamber (4*a*) communicating with the compressed air source via the longitudinal passage (7*a*) and the radial port (8), and the supplementary chamber (22*a*) and the rear chamber (15*a*) when said piston valve (3*a*) moves toward the working tool (13), and the end face (18) of its smaller step, facing away from the tool, is in the supplementary chamber (22*a*) which is communicated with the radial port (8); said central chamber communicating with the atmosphere via said additional port (21*a*) when the hammer (2) is delivering impacts on the working tool (13), while the piston valve (3*a*) moving away from the tool occupies a position relative to the housing (1*a*) in which the end face (18) of the smaller step of the piston valve (3*a*) has advanced beyond the intermediate chamber (22*a*).

4. A pneumatic tool as claimed in claim 2, wherein the central chamber (4*a*) accommodates a spring (27) disposed between the hammer (2) and the piston valve (3*a*) to prevent collision therebetween.

5. A pneumatic percussive power tool, comprising: a housing (1*b*) having an inner cylindrical cavity accommodating a working tool (13) in the head portion thereof; a dynamically-balanced percussive mechanism located in said cavity of the housing and including a hammer (2) and a two-step balancing piston valve (3*b*) disposed so that the length of its stroke can be adjusted automatically; said hammer and said piston valve reciprocating under the action of compressed air so that at the end of forward strokes the hammer (2) delivers blows on the tool (13) for acting on an object being treated; ssaid hammer (2) and said balancing piston valve (3*b*) dividing the inner cylindrical cavity of the housing (1*b*) into a head chamber (11) defined by the working tool (13), the housing and the hammer (2), a central chamber (4*b*) defined by the end face (5) of the hammer (2) facing in the direction away from the tool (13), the housing (1*b*) and the end face (6) of a larger step of the piston valve (3*b*), facing toward the tool; a rear chamber (15*b*) defined by the walls of the housing (1*b*) and the end face (18) of a smaller step of the piston valve (3*b*) facing in the direction away from the tool; a supplementary chamber (17*b*) defined by the end face (16) of the larger step of the piston valve (3*b*), the walls of the housing (1*b*) and the side surface of the smaller step of the piston valve (3*b*); and an intermediate chamber (22*b*) defined by the walls of the housing (1*b*) and the side surface of the smaller step of the piston valve (3*b*); a first passage (23*b*) provided in the housing (1*b*) and communicating permanently the central chamber (4*b*) with the intermediate chamber (22*b*); a port (9*b*) in the rear part of the housing (1*b*) and communicating permanently the rear chamber (15*b*) with a compressed air source; another port (14) provided in the front part of the housing (1*b*), communicating permanently the head chamber (11) with the atmosphere, with the hammer (2) so disposed relative to the housing (1*b*) that said another port (14) is not closed by the hammer (2); a second passage (19*b*) provided in the housing (1*b*) and communicating permanently the head chamber (11) with the supplementary chamber (17*b*); a further port (21*a*) provided in the housing (1*b*) communicating permanently with the atmosphere; said central chamber communicating with the compressed air source via the first passage (23*b*), and the intermediate chamber (22*b*) and the rear chamber (15*b*), when said piston valve (3*b*) moves toward the working tool (13), and the end face (18) of its smaller step, facing in the direction away from the tool, is in the intermediate chamber (22*b*), said central chamber communicating with the atmosphere via the further port (21*a*) when the hammer (2) is delivering impacts on the working tool (13), while the piston valve (3*b*), moving away from the tool, occupies a position relative to the housing (1*b*) in which the end face (18) of the smaller step of the piston valve (3*b*) has advanced beyond the intermediate chamber (22*b*).

6. A pneumatic tool as claimed in claim 4, wherein the central chamber (4*b*) accommodates a spring (27) disposed between the hammer (2) and the piston valve (3*b*) to prevent colliding engagement therebetween.

7. A pneumatic percussive power tool, comprising: a housing (1*c*) having an inner cylindrical cavity accommodating a working tool (13) in the head portion thereof; a dynamically-balanced percussive mechanism located in said cavity of the housing and including a hammer (2) and a two-step balancing piston valve (3*c*) disposed so that the length of its stroke can be adjusted automatically; said hammer and said piston valve reciprocating under the action of compressed air so that at the end of forward strokes the hammer (2) delivers blows on the tool for acting on an object being treated; said hammer (2) and said balancing piston valve (3*c*) dividing the inner cylindrical cavity of the housing (1*c*) into a head chamber (11) defined by the working tool (13), the housing (1*c*) and the hammer (2); a central chamber (4*c*) defined by the end face (5) of the hammer (2) facing in the direction away from the tool (13), the housing (1*c*) and the end face (6) of a larger step of the piston valve (3*c*) facing toward the tool; a rear chamber (15*c*) defined by the housing (1*c*), the end face (16) of the larger step of the piston valve (3*c*) facing in the direction away from the tool, and the side surface of a smaller step of the piston valve (3*c*); an intermediate chamber (22*c*) defined by the housing (1*c*) and the side surface of the smaller step of the piston valve (3*c*); and a supplementary chamber (17*c*) defined by the housing (1*c*) and the end face (18) of the smaller step of the piston valve (3*c*) facing in the direction away from the tool (13); a longitudinal passage (7) provided in the balancing piston valve (3*c*) and communicating permanently with the central chamber (4*c*); a radial port (8) in the piston valve (3*c*) and communicating permanently said longitudinal passage (7) with the side surface of the smaller step of the piston valve (3*c*); another port (9*c*) in the rear portion of the housing (1*c*) for communicating permanently the rear chamber (15*c*) with a compressed air source; a further port (14) in the front portion of the housing (1*c*) and communicating the head chamber (11) 4 the atmosphere, with the hammer (2) being so disposed relative to the housing (1*c*) that said further port (14) is not closed by the hammer (2); an additional port (19*c*) provided in the housing (1*c*) and communicating permanently the head chamber (11) with the supplementary chamber (17*c*); a still further port (21*a*) in the housing (1*c*) and communicating permanently with the atmosphere; a groove (24*c*) provided on the side surface of the smaller step of the piston valve (3*c*) to communicate alternately the intermediate chamber (22*c*) with the rear chamber (15*c*) and the central chamber (4*c*) by alternately connecting the intermediate chamber (22*c*) with the rear chamber (15*c*) when, during the movement of the piston valve (3*c*) in the direction away from the tool (13) the radial port (8) of the piston valve (3*c*) moves in the intermediate chamber (22*c*) and the groove (24*c*) enters the latter, and with the central chamber (4*c*) when during the movement of said piston valve (3*c*) toward the tool (13) the radial port (8) of the piston valve (3*c*) enters the intermediate chamber (22*c*) and the groove (24*c*) leaves the latter, said central chamber (4*c*) communicating with the atmosphere via said port (21*a*) when the hammer (2) is delivering impacts on the working tool (13), while the piston valve (3*c*) moving away from the tool occupies a position relative to the housing (1*c*) in which the radial port (8) of the piston valve (3*c*) has advanced beyond the intermediate chamber (22*c*).

8. A pneumatic tool as claimed in claim 7, wherein the central chamber (4*c*) accommodates a spring (27) disposed between the hammer (2) and the piston valve (3*c*) to prevent colliding engagement therebetween.

9. A pneumatic percussive power tool, comprising: a housing (1*d*) having an inner cylindrical cavity accommodating a working tool (13) in the head portion thereof; a dynamically-balanced percussive mechanism located in said cavity and including a hammer (2) and a two-step balancing piston valve (3*d*) disposed so that the length of its stroke can be adjusted automatically; said hammer and said piston valve reciprocating under the action of compressed air so that at the end of forward strokes the hammer (2) delivers impacts on the tool (13) for acting on an object being treated; said hammer (2) and said balancing piston valve (3*d*) dividing the inner cylindrical cavity of the housing into a head chamber (11) defined by the working tool (13), the housing and the hammer (2); a central chamber (4*d*) defined by the end face of the hammer (2) facing in the direction away from the tool, the housing and the end face of a larger step of the balancing piston valve (3*d*) facing toward the tool; a rear chamber (15*d*) defined by the end face (16) of the larger step of the piston valve (3*d*) facing in the direction away from the tool, the housing and the side surface of a smaller step of the piston valve (3*d*); a supplementary chamber (17*d*) defined by the housing (1*d*) and the end face (18) of the smaller step of the piston valve (3*d*) facing in the direction away from the tool; and an intermediate chamber (22*d*) defined by the housing and the side surface of the smaller step of the piston valve (3*d*); a longitudinal passage (7) provided in the balancing piston valve and communicating permanently with the central chamber (4*d*); a radial port (8) in the piston valve (3*d*) and communicating permanently said longitudinal passage (7) with the side surface of the smaller step of the piston valve (3*d*); another port (9*d*) in the rear portion of the housing (1*d*) and communicating permanently the rear chamber (15*d*) with a compressed air source; a further port (14) in the front portion of the housing (1*d*) and communicating the head chamber (11) with the atmosphere, with the hammer (2) being so disposed relative to the housing (1*d*) that said further port (14) is not closed by the hammer (2); a second passage (19*d*) provided in the housing (1*d*) and communicating permanently the head chamber (11) with the supplementary chamber (17*d*); an additional port (21*a*) in the housing (1*d*) and communicating permanently with the atmosphere; a groove (24*d*) provided on the side surface of the smaller step of the piston valve (3*d*) for communicating alternately the intermediate chamber (22*d*) with the reach chamber (15*d*) and the central chamber (4*d*) by alternately connecting the intermediate chamber (22*d*) to the rear chamber (15*d*) when, during the movement of the piston valve (3*d*) in the direction away form the tool (13), the radial port (8) of the piston valve (3*d*) leaves the intermediate chamber (22*d*) and the groove (24*d*) enters the latter, and to the central chamber (4*d*) when, during the movement of said piston valve (3*d*) toward the tool (13), the radial port (8) of the piston valve (3*d*) enters the intermediate chamber (22*d*) and the groove (24*d*) leaves the latter; a supplementary passage (25*d*) provided in the piston valve (3*d*), one end of said supplementary passage (25*d*) opening to the side surface of the larger step of said piston valve (3*d*) and the other end communicating permanently with the rear chamber (15*d*); an annular groove (26*d*) provided on the inner surface of the housing (1*d*) and communicating permanently with the second passage (19*d*) which connects the head chamber (11) and the supplementary chamber (17*d*), said annular groove communicating periodically with said supplementary passage (25*d*) via the first end of the latter when the piston valve (3*d*) moving in the direction away from the tool (13) occupies a position relative to the housing (1*d*) in which the first end of the passage (25*d*) in the piston valve (3*d*) is aligned with said annular groove (26*d*) in the housing (1*d*), and the hammer (2) delivers at that moment an impact on the tool (13), comressed air being admitted from the rear chamber (15*d*) into the head chamber (11) and the supplementary chamber via the supplemental passage (25*d*), the annular groove (26*d*) and the second passage (19*d*); said central chamber (4*d*) communicating with the atmosphere via said port (21*a*) when the hammer (2) delivers an impact on the working tool (13) and the piston valve (3*d*), moving in the direction away from the tool, occupies a position relative to the housing (1*d*) in which the radial port (8) of the piston valve (3*d*) has advanced beyond the intermediate chamber (22*d*).

10. A pneumatic tool as claimed in claim 9, wherein the central chamber (4*d*) accommodates a spring (27) disposed between the hammer (2) and the piston valve (3*d*) to prevent colliding impact therebetween.

* * * * *